US007930780B2

(12) United States Patent
Clenet

(10) Patent No.: US 7,930,780 B2
(45) Date of Patent: Apr. 26, 2011

(54) ADJUSTABLE BED FRAME ASSEMBLY

(76) Inventor: Alain Clenet, Goleta, CA (US)

( * ) Notice: Subject to any disclaimer, the term of this patent is extended or adjusted under 35 U.S.C. 154(b) by 0 days.

(21) Appl. No.: 12/154,509

(22) Filed: May 23, 2008

(65) Prior Publication Data

US 2008/0276373 A1 Nov. 13, 2008

Related U.S. Application Data

(63) Continuation-in-part of application No. 11/699,759, filed on Jan. 29, 2007, now abandoned.

(60) Provisional application No. 60/817,545, filed on Jun. 29, 2006.

(51) Int. Cl.
*A47B 7/02* (2006.01)

(52) U.S. Cl. ..... 5/618

(58) Field of Classification Search ..... 5/618, 722, 5/249–251, 617, 613
See application file for complete search history.

(56) References Cited

U.S. PATENT DOCUMENTS 2,995,762 A * 8/1961 Albinson ..... 5/411
4,258,445 A 3/1981 Zur
4,437,702 A * 3/1984 Agosta ..... 297/284.8
5,062,171 A * 11/1991 Vrzalik ..... 5/713
5,235,258 A 8/1993 Schuerch
5,544,376 A 8/1996 Fromson
5,687,437 A * 11/1997 Goldsmith ..... 5/611
6,006,379 A * 12/1999 Hensley ..... 5/618
6,393,641 B1 5/2002 Hensley
6,735,797 B1 * 5/2004 Long et al. ..... 5/118
6,826,793 B2 * 12/2004 Tekulve ..... 5/618

* cited by examiner

*Primary Examiner* — Robert G Santos
*Assistant Examiner* — Nicholas Polito
(74) *Attorney, Agent, or Firm* — Felix L. Fischer

(57) ABSTRACT

A bed frame comprises a lower support structure having a head end and a foot end and a carriage arranged for translational movement on the lower support structure. An upper support structure is mounted on the carriage. The upper support structure includes a seat and an upper body support section pivotally connected thereto. A support arm is pivotally connected between the lower support structure and the upper body support section. An actuator is connected to the lower support structure. A lever arm is connected between the actuator and the carriage. Application of force from the actuator to the lever arm moves the carriage on the lower support structure while applying a lifting moment to the upper body support section. The support arm is arranged such that movement of the carriage toward the head end of the lower support structure also produces a lifting moment on the upper body support section.

7 Claims, 7 Drawing Sheets

ADJUSTABLE BED FRAME ASSEMBLY

CROSS REFERENCE TO RELATED APPLICATION

This is a continuation-in-part of U.S. patent application Ser. No. 11/699,759, filed Jan. 29, 2007 now abandoned and which claimed priority based upon U.S. Provisional patent application No. 60/817,545, filed Jun. 29, 2006.

BACKGROUND OF THE INVENTION

1. Field of the Invention

This invention relates generally to furniture and particularly to beds. Still more particularly this invention relates to articulating bed frames. Still more particularly, this invention relates to an articulating bed frame suitable for residential use.

2. Description of Prior Art

U.S. Pat. No. 6,006,379, which issued Dec. 28, 1999 to Hensley was cited as a reference in the parent application Ser. No. 11/699,759 referenced above. Hensley discloses an articulating bed frame in which a seat frame section of an articulating upper frame is fixed upon a carriage. The carriage is mounted on rollers arranged to roll along channels that are part of a base frame. An upper body frame section is pivotally mounted at one edge to an adjacent edge of the seat frame section. Support members extend between the upper frame section and the base frame to support the upper body section when it is horizontal. A drive system is provided for lifting and lowering the upper body frame section. The drive system includes an actuator having a first end pivotally connected to the base frame and a second end pivotally connected to the carriage. The drive system is arranged to move the carriage linearly along the channels. A linkage assembly has a first end pivotally connected to the base frame and a second end pivotally connected to the carriage. The linkage assembly is connected to the upper body frame section between the head end thereof and the pivot point where the upper body frame section and the seat frame section are connected together. When the actuator moves the carriage toward the head end of the frame, a support member of the linkage assembly is placed in compression and causes the upper body frame section to tilt upwardly from its horizontal position. This lifting action occurs because the portion of the upper body frame section between its pivotal connection to the seat frame section and the pivotal connection of the linkage to the upper body frame section acts as a lever arm to produce a torque about the pivot point of the upper body frame section relative to the seat frame section. The linkage assembly causes the upper body frame section to move back toward its horizontal position when the actuator moves the carriage toward the foot end of the frame. Without the linkage assembly, linear motion of the carriage caused by the actuator would exert no torque, or lifting moment on the upper body frame section. If the upper body frame section were lowered to a point where the link assembly is horizontal, the upper body frame section could not be raised again by linear motion of the carriage toward the head end of the frame.

SUMMARY OF THE INVENTION

It is an object of the present invention to provide an articulating bed frame that may be substituted for a box spring assembly commonly found in beds suitable for residential usage so that an ordinary bed may have an articulating frame installed therein.

A bed frame according to the present invention comprises a lower support structure having a head end and a foot end and a carriage arranged for translational movement on the lower support structure. The bed frame further includes an upper support structure mounted on the carriage so as to be movable therewith. The upper support structure includes a seat section with an upper body support section being pivotally connected to the seat. A support arm has a first end pivotally connected to the lower support structure and a second end pivotally connected to the upper body support section. An actuator is connected to the lower support structure. A lever arm has a first end connected to the actuator and a second end rigidly connected to the upper body support structure adjacent where the edge thereof is pivotally connected to the seat section. The actuator and lever arm are arranged such that application of force from the actuator to the first end of the lever arm provides a motive force for moving the carriage and the upper support structure on the lower support structure while also producing a first lifting moment on the upper body support section. The support arm is arranged such that movement of the carriage toward the head end of the lower support structure produces a second lifting moment on the upper body support section. The first and second lifting moments cooperate to pivot the upper body support section about its connection point to the seat.

The invention may further include apparatus for retaining a mattress in a selected position on the upper support structure. The retaining apparatus preferably includes a first rigid plate adhesively fastened to a lower side portion of the mattress, the first plate having a first passage therethrough, a bushing mounted in the first passage and having a flange portion that is connected to the plate, a rod having a first end connected to the bushing, a second rigid plate connected to the seat section of the upper support section and having a second passage therethrough with the rod having a second end extending through the second passage, and a retainer structure connected to the second end of the rod to connect the first and second plates securely together and thereby retain the mattress in a selected position on the upper support structure.

DETAILED DESCRIPTION OF THE INVENTION

Figure 1:
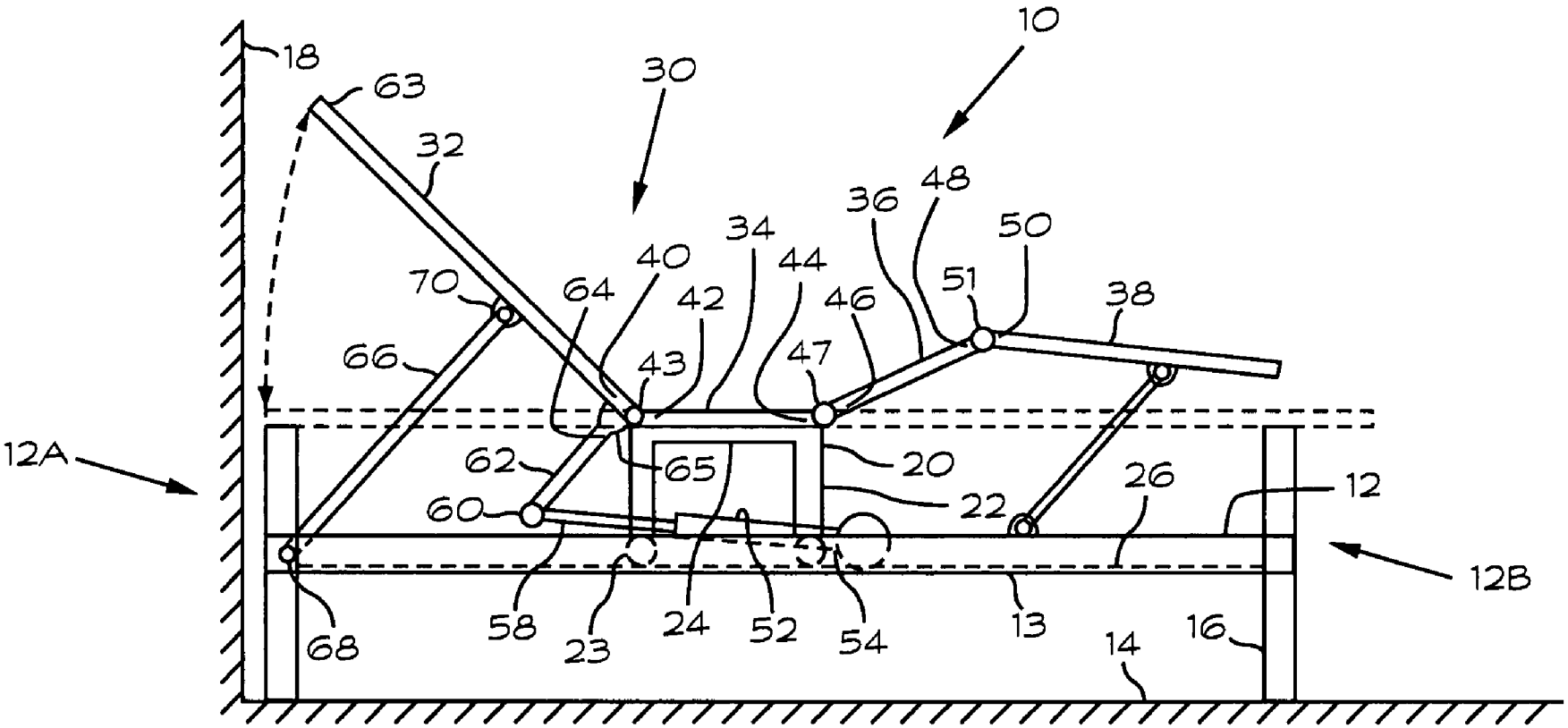
FIG. 1 is a side elevation view of the articulated bed frame according to the present invention.

As shown in FIG. 1B a bed frame 10 according to the present invention includes a lower support structure 12 that is in contact with a floor 14 through a plurality of legs 16 that are preferably removable. The lower support structure 12 has a head end 12A and a foot end 12B.

A carriage 20 is arranged to travel lengthwise on the lower support structure 12. The carriage 20 has a plurality of legs 22 that extend from a platform 24. The legs 22 preferably include rollers 23 arranged to roll upon a pair of lengthwise side rails 26 that are included in the lower support structure 12. An upper support structure 30 is mounted on the platform 24 so that the upper support structure 30 is movable with the carriage. The upper support structure 30 comprises an upper body support section 32, a seat support section 34, a thigh support section 36 and a lower leg support section 38. The seat support section 34 is fixed to the carriage 20 for translational movement therewith. A hinge assembly 43 pivotally connects an edge 40 of the upper body support section 32 to an edge 42 of the seat support section 34. A hinge assembly 47 pivotally connects an edge 44 of the thigh support section 34 to an edge 46 of the seat support section 34. A hinge assembly 51 pivotally connects an edge 48 of the lower leg support section 36 to an edge 50 of the seat support section 34.

Figure 2:
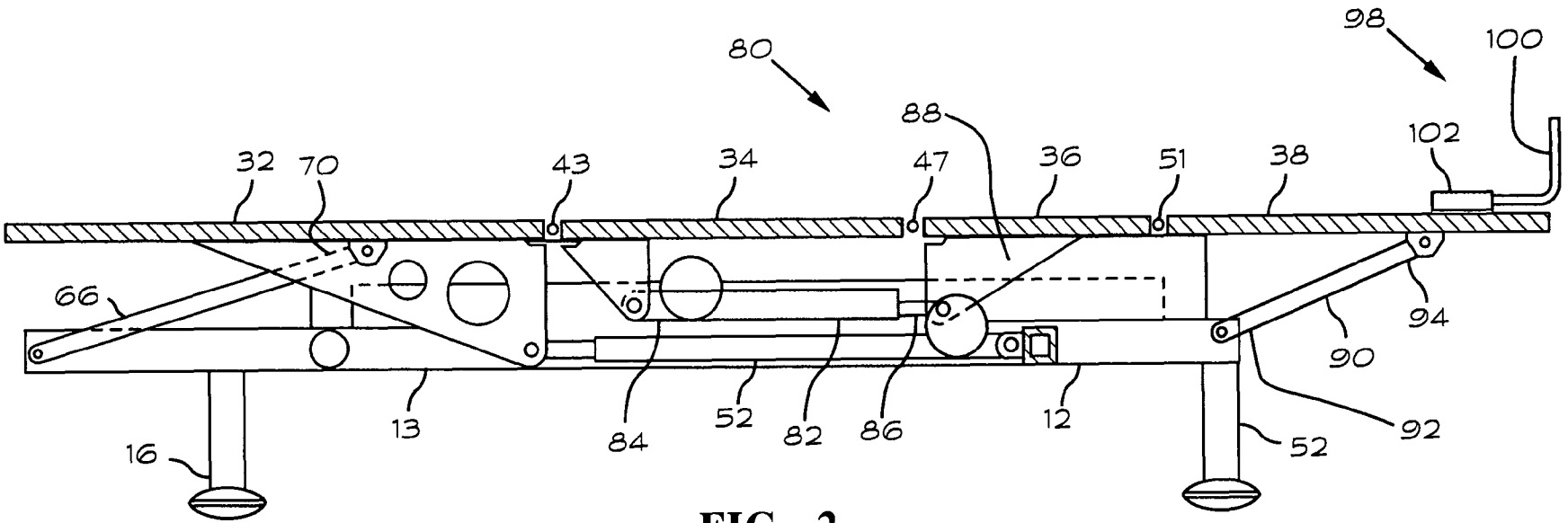
FIG. 2 is a side elevation view showing additional structural features of the invention.
Figure 3:
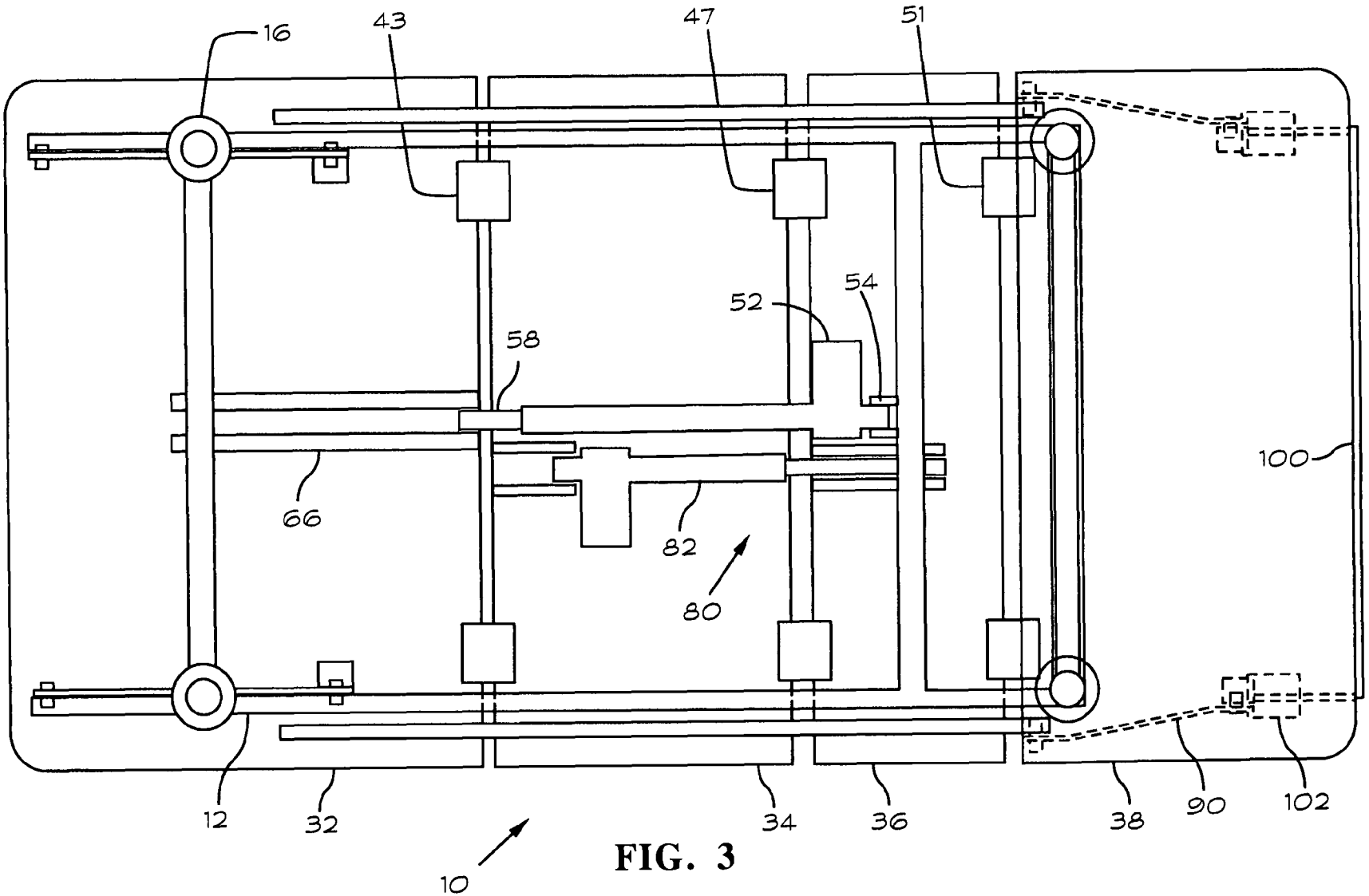
FIG. 3 is a bottom plan view of the articulated bed frame according to the present invention.

As shown in FIGS. 1-3, a linear actuator 52 has a first end 54 that is pivotally attached to the lower support structure 12. A second end 58 of the linear actuator 52 is pivotally attached to a first end 60 of a lever arm 62. A second end 64 of the lever arm 62 is rigidly attached by any suitable means, such as welding, to a bracket 65 fixed to the upper body support section 32 near the edge 40. The actuator 52 applies a tensile force to the end 60 of the lever arm 62, which is spaced apart from the pivotal connection between the upper body support section 32 and the seat section.

When the linear actuator 52 pushes on the first end 60 of the lever arm 62, the result is a lifting moment on the upper body support section 32. This lifting moment causes the upper body section 32 to rotate clockwise (as seen if FIG. 1) about the hinge 43 that connects the upper body section 32 with the seat support section 34, thus raising an end 63 of the upper body support section 32. At the same time, the carriage 20, the upper body support section 32, the seat section 34, the thigh support section 36 and the lower leg support section 38 all move toward the wall 18. This movement toward the wall 18 keeps the upper support structure 30 at a nearly constant distance from the wall 18 so that a user may have easy access to items on a bedside table for all positions of the upper body support section 32. A support arm 66 has a first end 68 pivotally connected to the lower support structure 12 and a second end 70 pivotally connected to the upper body support section 32 between the hinge assembly 43 and the head end 63. Motion of the carriage 20 toward the head end 12A of the lower support structure 12 exerts a force in the support arm 66 that assists in pivoting the upper body support section 32 to lift its end 63 relative to the seat section 34. The action of the actuator 52 on the lever arm 62 and the support arm 66 creates a double simultaneous lifting action upon the upper body support section 32. The lifting moments provided by the lever arm 62 and the support arm 66 cooperate to allow the frame 10 to have a desirable overall limited height of about 4.5 in as opposed to a height of about eight inches that is possible with the structure disclosed in U.S. Pat. No. 6,006,379. The lever arm 62 permits the actuator 52 to apply a lifting moment to the upper body section 32 even in a configuration where the support arm 66 is horizontal and therefore unable to lift the upper body support section 32. The prior art structure of U.S. Pat. No. 6,006,379 described in the background of the invention is not suitable for forming a bed frame of such small height because of limitations on the available lifting moment that that the support arm described therein can be provided at small angles. The overall height of the bed frame 10 according to the present invention makes it suitable for placement in standard bed frames presently used in residences.

As shown in FIGS. 2 and 3, the bed frame 10 also preferably includes a lifting mechanism 80 that lifts the thigh support section 36 and the lower leg section 38. U.S. Pat. No. 4,258,445, which issued Mar. 31, 1981 to Zur, discloses a suitable structure for the leg lifting mechanism 80. The disclosure of U.S. Pat. No. 4,258,445 is incorporated by reference into the present disclosure. A brief description of the leg lifting mechanism 80 is included herein so that the entire bed frame 10 is described.

Referring to FIGS. 2 and 3, a linear actuator 82 has a first end 84 pivotally connected to the seat support 34 and a second end 86 pivotally connected to a bracket 88 that is fixed to the thigh support section 36. A support member 90 has a first end 92 connected to the lower support structure 12 and an upper end 94 connected to the lower leg support section 38. When the linear actuator 82 pushes on the bracket 88 to raise the thigh support section 36, the support member 90 raises the foot end of the lower leg support section 38.

As shown in FIGS. 2 and 3, the bed frame 10 may include a mattress retainer 98 connected to the lower leg support section 38. The mattress retainer 98 includes a retainer bar 100 that is connected to a bracket 102 that is in turn secured to the lower leg section 38. The retainer bar 100 is arranged to extend vertically above the foot end of the lower leg section 38 when the frame 12 is fully assembled. The retainer bar 100 may be arranged to extend downward as shown in the dashed lines 100A of FIGS. 4 and 5 to make the bed frame as compact as possible for shipping in a container such as cardboard box (not shown). The legs 16 are formed for easy attachment and removal from the frame 12, which also contributes to making the frame 12 easier and less expensive to ship from a factory or warehouse to a customer.

It should be noted that other than the legs 16, no structural features of the frame 12 extend below the lowermost frame member 13 for any position of the upper support structure 30. The legs 16 are an optional feature of the bed frame 12, which may be used without them. This feature permits use of the frame 12 without the legs 16 being attached so that the frame 12 will function properly when placed directly on any horizontal support such as the floor 14 or an existing bed frame (not shown).

Figure 4:
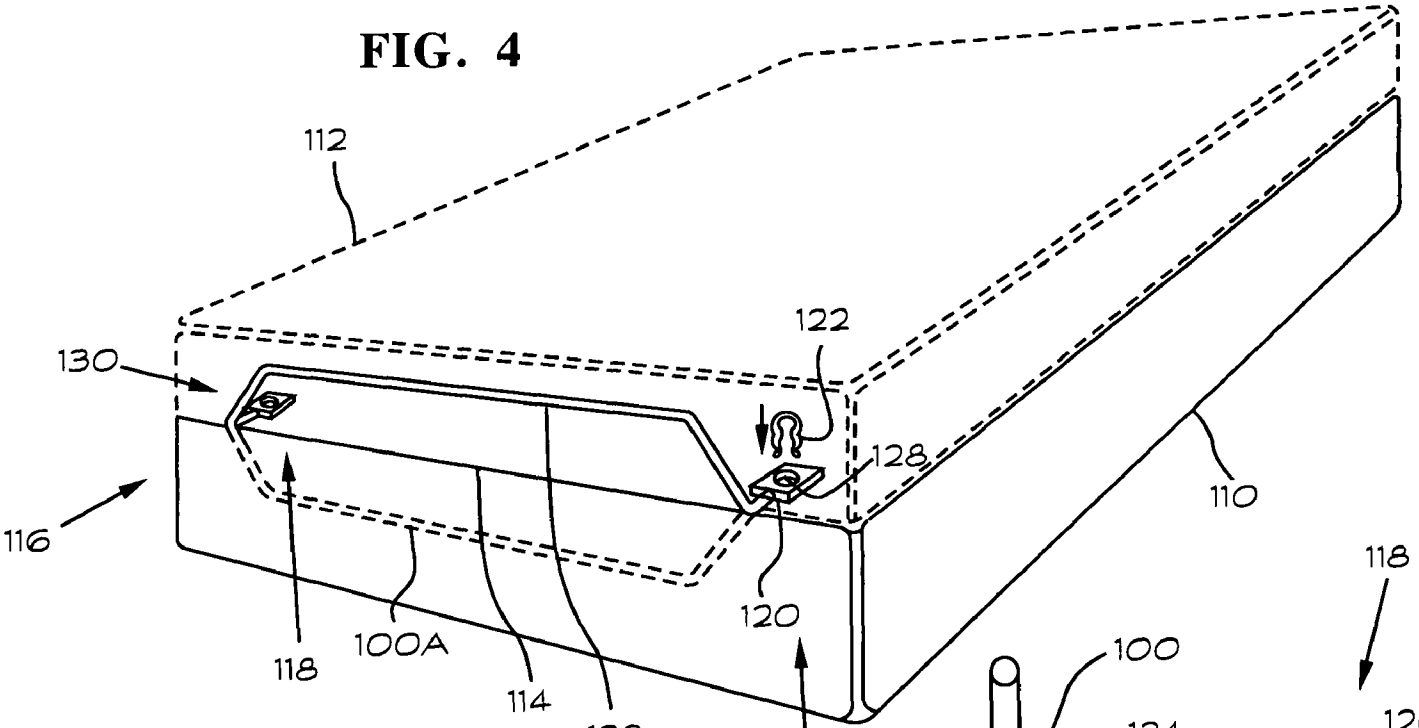
FIG. 4 is a perspective view showing a mattress retainer on the bed frame according to the present invention.
Figure 5:
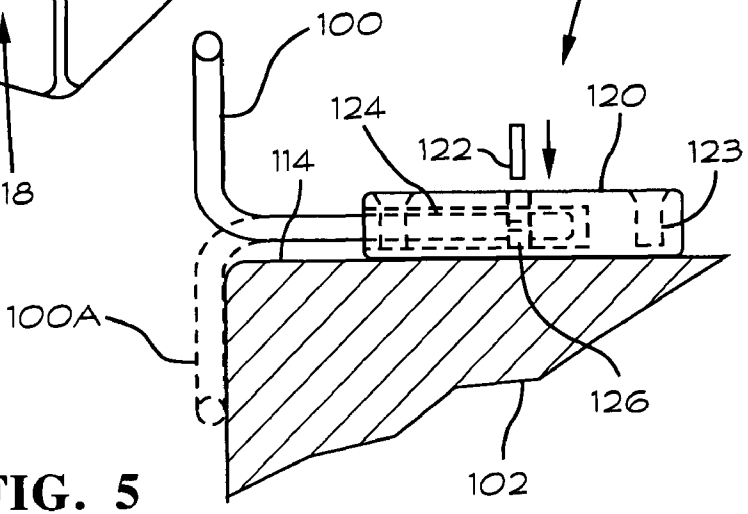
FIG. 5 is a cross sectional view showing a mattress retainer that may be included in the bed frame according to the present invention.

As shown in FIG. 4, the bed frame 10 may include a mattress platform 110 that supports a mattress 112. The mattress platform 110 has a foot end 114. As shown in FIGS. 4 and 5, a pair of bracket assemblies 118 mounts a mattress retainer 116 to the mattress platform 110. Each of the bracket assemblies 118 includes an injection molded receptacle 120 and a retainer clip 122. Screws 123 may be used to secure the receptacle to the mattress platform. The mattress retainer 116 includes a pair of rods 124 that extend into a cylindrical passage 126 in the receptacle 120. The rods 124 have a reduced diameter portion 126 where the retainer clips 122 may be inserted into passages 128 to engage the reduced diameter portions 126 and thereby retain the rods 124 with the passages 126.

A retainer bar 130 extends between the rods 124 and extends vertically from the mattress platform 110 a distance sufficient to prevent the foot end 114 from sliding lengthwise off the mattress platform 110.

The mattress retainer 116 is designed so that the mattress platform 110 may be made as compact as possible for shipping. Normally the mattress platform 110 is to be shipped with the retainer bar portion arranged to extend downward as indicated by the dashed lines 132A. The clips 122 are removed from the retainers 120 so that the rods 124 may be removed from the receptacles 120. The clips 122 may be removed and reinserted into the receptacles 120 without requiring the use of any tools. The retainer bar 130 is then turned over so that the retainer bar 130 is in its upward position to retain the mattress in position as described above.

Figure 7B:
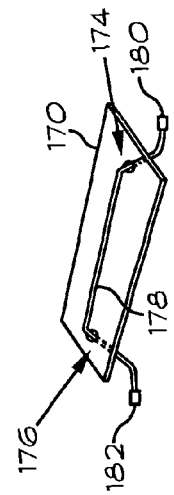
FIG. 7B is a perspective view of a portion of the apparatus of FIG. 7A.
Figure 7C:
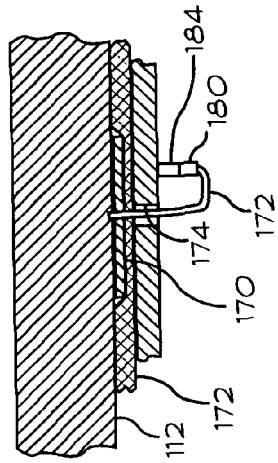
FIG. 7C is a side elevation view showing apparatus for connecting a mattress to the bed frame to restrain the mattress against sliding as the bed frame is articulated.
Figure 8:
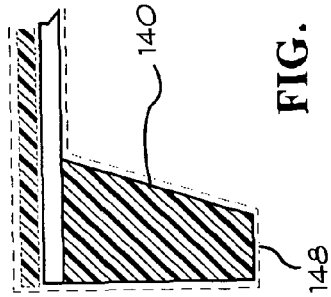
FIG. 8 is a cross sectional view showing an end of a foam structure that may be included in the invention.
Figure 6:
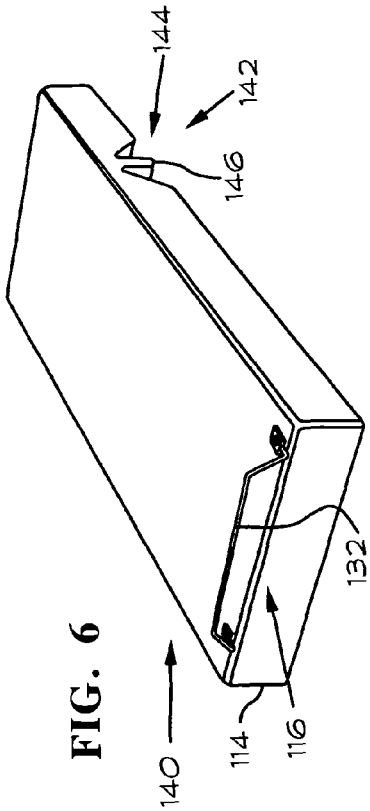
FIG. 6 is a perspective view showing the articulated bed frame according to the present invention.
Figure 7A:
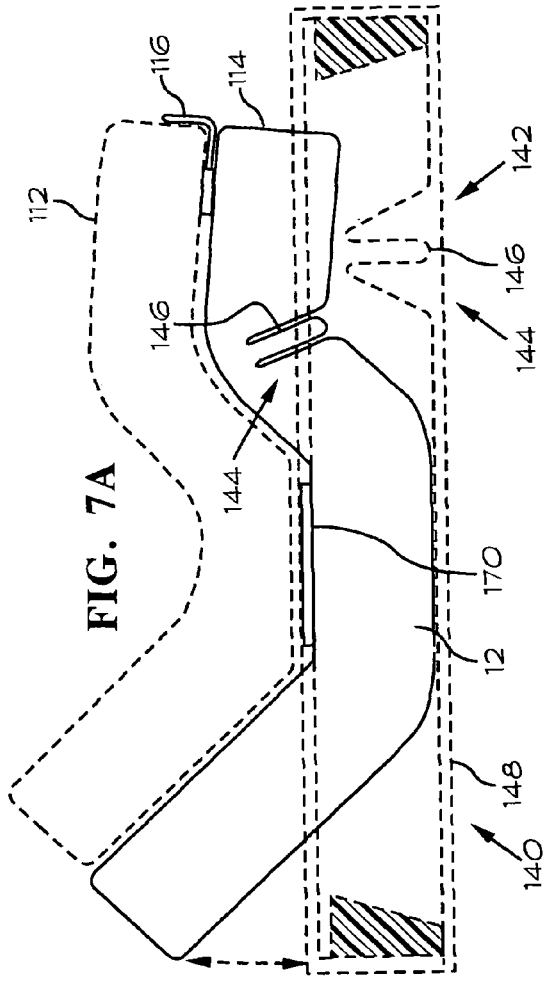
FIG. 7A is a side elevation view of the articulated bed frame of FIG. 6.

FIGS. 6, 7A and 8 illustrate additional features of the bed frame 10 according to the present invention. FIG. 8 shows a foam edge 140 of the frame 12. A bottom portion 142 has a plurality of troughs 144 therein that extend across the foam edge 140. As shown in the elevation view of FIG. 7A, the troughs 144 each have a generally triangular cross section so that the bottom portion 142 of the foam edge 140 has a generally corrugated configuration. FIGS. 6 and 7A show the foam edge 140 having two parallel troughs 144 with a projection 146 extending between them. When the thigh support section 36 of the upper support structure 30 becomes elevated, the lower leg support section 38 pivots about the hinge assembly 51 so that the foot end of the bed is lower that the hinge assembly 51. As the lower leg support pivots relative to the thigh support section 36, the mattress 140 folds at the bottom portion 142 so that the widths of the troughs decreases as shown in FIG. 7A. The corrugated effect created by the troughs 144 prevents the foam edge 140 from buckling as it folds from its flat position shown in FIG. 6 and in the dashed lines of FIG. 7A to the folded configuration shown in solid lines in FIG. 7A.

The foam edge 140 may include a fabric 148 that covers the foam so that the troughs 144 are not visible and so that the edges of the mattress 140 appear to be a smooth line.

FIGS. 7A-7C illustrate an alternative means for retaining the mattress 112 in the desired position on the bed frame frame 10. It is well-known that as the frame 10 adjusts into different configurations, there is a tendency for the mattress 112 to move toward the foot end.

FIG. 7A shows a flat member 170 connected to the bottom side of the mattress 112. The flat member 170 may be formed of materials such as wood, plastic, metal etc. and is preferably secured to the mattress with an adhesive. To prevent the flat member 170 from separating from the mattress 112, a layer of mesh or fabric 172 may be used to cover the flat member 170 as shown in FIG. 7C.

As shown in FIG. 7B, one or more holes 174 and 176 are formed in the flat member 170. A cord 178 passes through the holes 174 and 176. The cord 178 has snap fasteners 180 and 182 connected to its ends. As shown in FIG. 7C, the snap fastener 180 may be connected to a snap receptacle 184 that is attached to the platform 34. The snap fastener 182 is connected to a similar snap receptacle (not shown). The cord 178 may be formed as a rope, cable or the like. Having the cord 178 fastened to the platform 34 restrains the mattress 112 against vertical movement (bridging) relative to the platform 34 as the mattress position is adjusted to raise the head and foot sections.

Figure 7D:
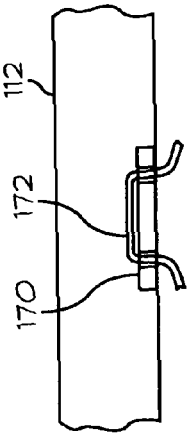
FIG. 7D shows an alternative arrangement for connecting the mattress to the bed frame.

The flat member 170 may alternatively be integrated into the foam mattress structure 112 as shown in FIG. 7D provided that the fabric 170 is used to cover the mattress 112.

Figure 9:
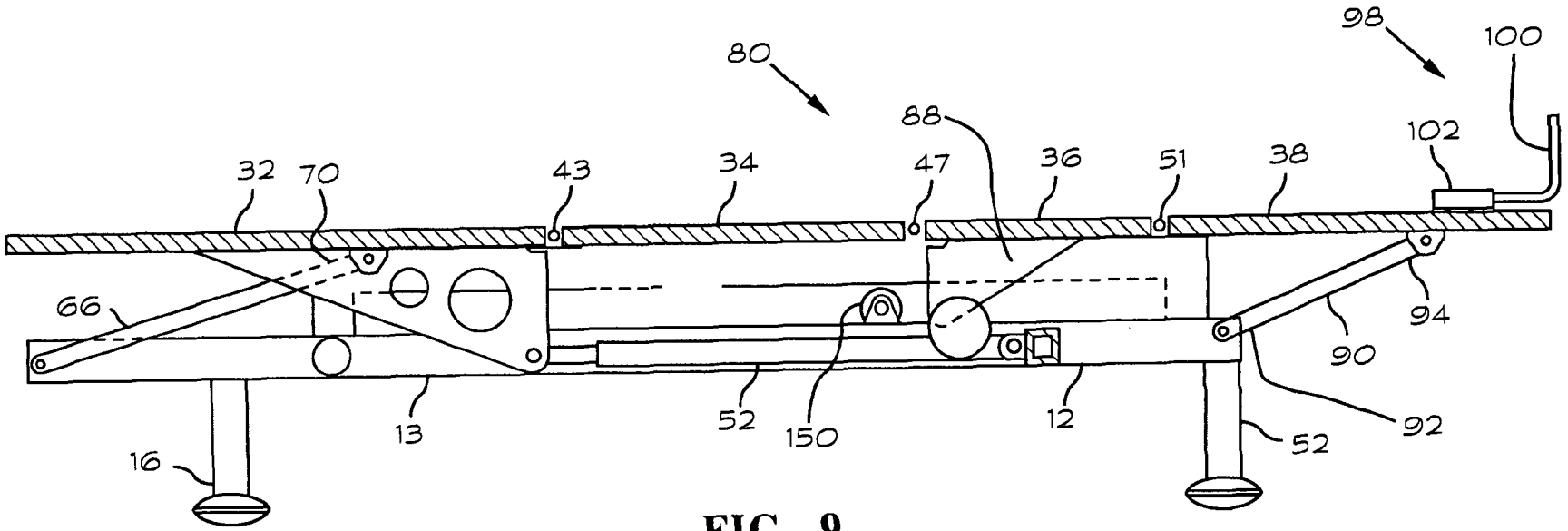
FIG. 9 is a side elevation view showing an alternative means for lifting the foot end of the bed frame.

FIG. 9 shows an alternative means for raising and lowering the thigh support section 36 and the lower leg support section 38 using the motor 52. As the upper support structure 20 moves to the left as seen in FIG. 9 over the lower structure 12, the bracket 88 comes into contact with a detent 150. The detent 150 is shown as a wheel that is mounted on the lower structure 12. The timing of the lifting of the foot end is determined by the location of the detent 150 on the lower structure 12.

Figure 10:
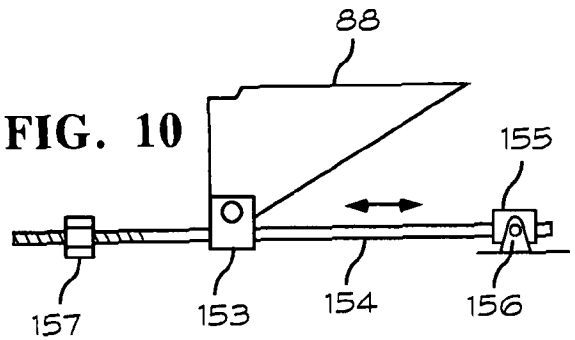
FIG. 10 is a side elevation view showing details of a portion of the apparatus of FIG. 9 for lifting the foot end of the bed frame.

Referring to FIG. 10 the detent 150 may be formed as a cube 153 rotatably attached to bracket 88. A bar 154 is arranged to slide through a passage in the cube 153. The bar 154 has an end 155 that is rotatably attached to the lower structure 12 by a bracket assembly 156. A nut 157 is mounted on a threaded portion of the bar 154. When the upper support structure moves to the left as seen in FIG. 9, the bracket 88 moves toward the nut 157. When the bracket 88 contacts the nut 157, the foot end of the bed frame begins to elevate. The position of the nut 157 may be varied to control the timing of the lifting of the foot end of the bed.

Figure 11:
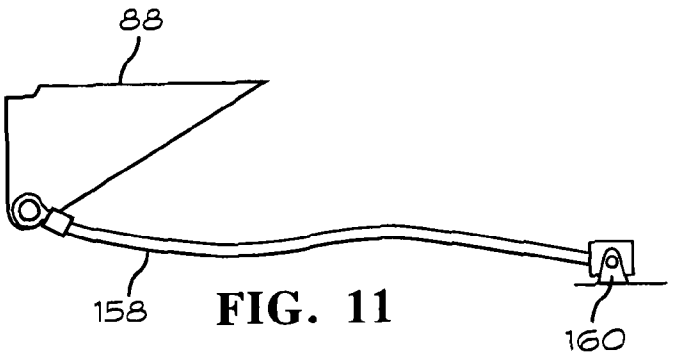
FIG. 11 is a side elevation view of another structure for lifting the foot end of the bed frame.

FIG. 11 shows another means for lifting the foot end of the bed. A cable 158 is connected between the bracket 88 and a bracket 160. The bracket 160 is mounted to the lower structure 12 so that tension in the cable 158 pulls the foot end into an elevated position.

Figure 12:
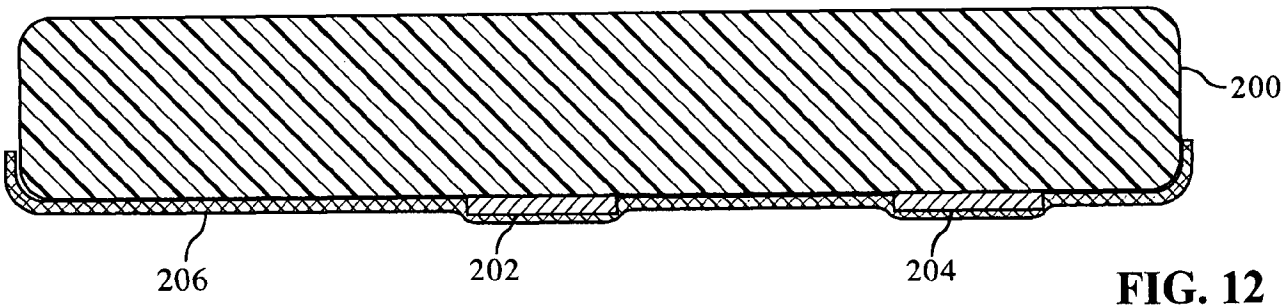
FIG. 12 is a cross sectional view showing a fabric covering a pair of boards that are attached to a mattress.

FIG. 12 shows locations where the seat support section 34 and the lower leg support section 38 may be attached to a mattress 200. A pair of boards 202 and 204, preferably formed of plywood or the like, are adhesively attached to the mattress 200 at locations such that the boards 202 and 204 may be vertically aligned with the seat support section 32 and the lower leg support section 38. The boards 202 and 204 and the bottom side of the mattress 200 are covered with a fabric 206 such as woven nylon. The fabric, which may be adhesively attached to the mattress 200 and the boards 202 and 204, prevents the mattress from peeling away from the boards 202 and 204 as the mattress 200 folds in response to raising or lowering the upper body support section 34 and the lower leg support section 38. A foam layer 207 may be placed adjacent the fabric 206.

Figure 13:
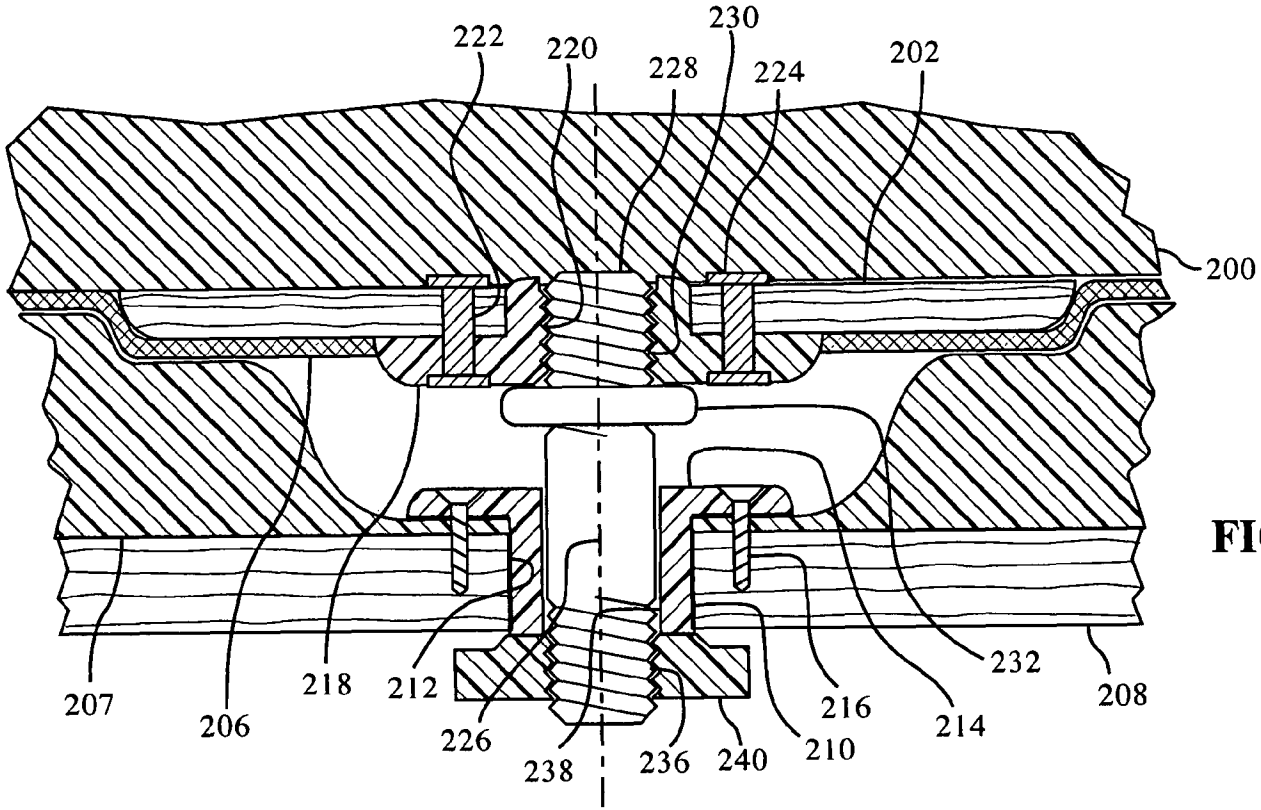
FIG. 13 is a cross sectional view showing structural features of apparatus for connecting a mattress to support platform.

Referring to FIG. 13, the seat support section 34 includes a board 208 fastened to the frame 10. A grommet 210 is mounted in a passage 212 in the board 208. An end 214 of the grommet 210 preferably is fastened to the board 208 using suitable wood screws 216 or the like. The grommet 210 may be formed of a suitable plastic or metallic material.

Before the board 202 is attached to the mattress 200 a bushing 218 having a threaded passage 220 is mounted in a hole 222 in the board 202 by means of fasteners 224 such as rivets. The passages 212 and 220 are arranged to be in longitudinal alignment along a common centerline 226. A rod 228 has a first end 230 threadedly engaged with the threaded bushing 218. The rod 228 may be formed of any suitable plastic or metallic material. A nut 232 is placed on the rod 228 and arranged to be secured against an edge portion 234 of the bushing 218. The mattress 200 with the rod 228 mounted to the board is placed upon the frame 10 with the other end 236 of the rod 228 extending through a passage 238 in the grommet 210. A knob 240 is then threadedly engaged with the end 236 of the rod 228 to retain the rod 228 such that it is securely mounted in the grommet 210.

The board 204 is mounted to the lower leg support section 38 in the same manner as described above for the board 202. Each of the boards 202 and 204 may be attached to the frame 10 in a plurality of locations by means of the procedures and apparatus described above. Attaching the mattress 200 to the frame 10 as described above retains the mattress in the desired position as the leg support and upper body support sections are raised or lowered.

From the foregoing, it is readily apparent that the present invention comprises a new, unique, and exceedingly useful bed frame that constitutes a considerable improvement over the known prior art. Many modifications and variations of the present invention are possible in light of the above teachings. It is to be understood that within the scope of the appended claims the invention may be practiced otherwise than as specifically described, such as lounge chairs.

What is claimed is:

1. An articulated bed assembly, comprising:

a lower support structure having a head end and a foot end with a pair of lengthwise side rails;

a carriage having a plurality of legs extending from a platform, said legs including rollers arranged to roll on said side rails for translational movement on the lower support structure;

an upper support structure including a seat section, said seat mounted on the carriage so as to be movable therewith, an upper body support section having an edge pivotally connected to the seat section, a thigh support section pivotally connected to the carriage;

a lower leg support section pivotally connected to the thigh support section; and retainer means for restraining the foot end of the upper support structure against translational movement toward the head end so that translational movement of the seat portion toward the head end causes the foot end of the bed flame to elevate:

a support arm having a first end pivotally connected to the lower support structure and a second end pivotally connected to the upper body support section; an actuator connected to the lower support structure; and a lever arm having a first end pivotally connected to the actuator and a second end rigidly connected to the upper body support structure adjacent where the edge thereof is pivotally connected to the seat section, the actuator and lever arm being arranged such that application of force from the actuator to the first end of the lever arm provides a motive force for moving the carriage and the upper support structure on the lower support structure while also producing a first lifting moment on the upper body support section, the support arm being arranged such that movement of the carriage toward the head end of the lower support structure produces a second lifting moment on the upper body support section, the first and second lifting moments cooperating to pivot the upper body support section about its connection point to the seat.

2. The articulated bed assembly of claim 1 wherein the retainer means includes a bracket attached to the thigh support and a detent attached to the lower support structure such that pressure between the bracket and the detent lifts the thigh and foot support sections.

3. An articulated bed assembly comprising:

a lower support structure having a head end and a foot end;

a carriage arranged for translational movement on the lower support structure;

an upper support structure including a seat section and an upper body support section having an edge pivotally connected to the seat, said seat mounted on the carriage so as to be movable therewith, a thigh support section pivotally connected to the carriage, a lower leg support section pivotally connected to the thigh support section, and retainer means for restraining the foot end of the upper support structure against translational movement toward the head end so that translational movement of the seat portion toward the head end causes the foot end of the bed frame to elevate, the retainer means including a bracket attached to the thigh support and a detent attached to the lower support structure such that pressure between the bracket and the detent lifts the thigh and foot support sections and a first bracket connected to the thigh support section, a second bracket connected to the lower support section and a cable connected between the first and second brackets so that tension in the cable lifts the thigh and foot support sections a support arm having a first end pivotally connected to the lower support structure and a second end pivotally connected to the upper body support section; an actuator connected to the lower support structure; and a lever arm having a first end pivotally connected to the actuator and a second end rigidly connected to the upper body support structure adjacent where the edge thereof is pivotally connected to the seat section, the actuator and lever arm being arranged such that application of force from the actuator to the first end of the lever arm provides a motive force for moving the carriage and the upper support structure on the lower support structure while also producing a first lifting moment on the upper body support section, the support arm being arranged such that movement of the carriage toward the head end of the lower support structure produces a second lifting moment on the upper body support section, the first and second lifting moments cooperating to pivot the upper body support section about its connection point to the seat.

4. An articulated bed comprising:

a lower support structure having a head end and a foot end;

a carriage arranged for translational movement on the lower support structure;

an upper support structure including a seat section and an upper body support section having an edge pivotally connected to the seat, said seat mounted on the carriage so as to be movable therewith, a thigh support section pivotally connected to the carriage, a lower leg support section pivotally connected to the thigh support section, and retainer means for restraining the foot end of the upper support structure against translational movement toward the head end so that translational movement of the seat portion toward the head end causes the foot end of the bed frame to elevate;

a support arm having a first end pivotally connected to the lower support structure and a second end pivotally connected to the upper body support section;

an actuator connected to the lower support structure; and a lever arm having a first end pivotally connected to the actuator and a second end rigidly connected to the upper body support structure adjacent where the edge thereof is pivotally connected to the seat section, the actuator and lever arm being arranged such that application of force from the actuator to the first end of the lever arm provides a motive force for moving the carriage and the upper support structure on the lower support structure while also producing a first lifting moment on the upper body support section, the support arm being arranged such that movement of the carriage toward the head end of the lower support structure produces a second lifting moment on the upper body support section, the first and second lifting moments cooperating to pivot the upper body support section about its connection point to the seat;

a mattress;

a pair of first rigid plates adhesively fastened in spaced relation to a lower side portion of the mattress, each first plate having a first passage therethrough;

a bushing mounted in the first passage and having a flange portion that is connected to each plate;

a rod having a first end connected to the bushing;

a pair of second rigid plates connected to the seat section and lower leg support section and each having a second passage therethrough with the rod having a second end extending through the second passage; and a retainer structure connected to the second end of the rod to connect the first and second plates securely together and thereby retain the mattress in a selected position on the seat section and lower leg support section.

5. The articulated bed frame assembly of claim 4, further comprising a fabric layer adhesively connected to cover the lower side of the mattress and the pair of first plates.

6. The articulated bed frame assembly of claim 5 wherein the retainer structure comprises:

a grommet mounted in the second passage and connected to the second plate;

a nut threadedly engaged with the second end of the rod to fasten the second plate to the rod and thereby connect the first and second plates together.

7. An articulated bed frame assembly, comprising:

a lower support structure having a head end and a foot end;

a carriage arranged for translational movement on the lower support structure;

an upper support structure mounted on the carriage so as to be movable therewith, the upper support structure including a seat and an upper body support section pivotally connected to the seat;

a support arm having a first end pivotally connected to the lower support structure and a second end pivotally connected to the upper body support section;

an actuator connected to the lower support structure;

a lever arm having a first end connected to the actuator and a second end rigidly connected to the upper body support structure adjacent where the edge thereof is pivotally connected to the seat section, the actuator and lever arm being arranged such that application of force from the actuator to the first end of the lever arm provides a motive force for moving the carriage and the upper support structure on the lower support structure while also producing a first lifting moment on the upper body support section, the support arm being arranged such that movement of the carriage toward the head end of the lower support structure produces a second lifting moment on the upper body support section, the first and second lifting moments cooperating to pivot the upper body support section about its connection point to the seat;

the upper support structure also including a thigh support section pivotally connected to the carriage and a lower leg support section pivotally connected to the thigh support section and wherein a mattress retainer includes a pair of brackets mounted to the lower leg support section and a retainer bar that is demountably connected to the pair of brackets, the retainer bar having a central portion that extends upward from the lower leg support section when the bed frame is assembled for use, the retainer bar being mounted in the brackets with the central portion upside down to reduce the height of the bed frame when the bed frame is packaged for shipping; and a retainer arranged to restrain the foot end of the upper support structure against translational movement toward the head end so that translational movement of the seat portion toward the head end causes the foot end of the bed frame to elevate, the retainer including a first bracket connected to the thigh support section, a second bracket connected to the lower support section and a cable connected between the first and second bracket so that tension in the cable lifts the thigh and foot support sections.

* * * * *